US012459692B2

(12) United States Patent
Domenichini

(10) Patent No.: US 12,459,692 B2
(45) Date of Patent: Nov. 4, 2025

(54) SHRINK WRAPPER MACHINE

(71) Applicant: OCME S.R.L., Parma (IT)

(72) Inventor: Giovanni Domenichini, Basilicagoiano Montechiarugolo (IT)

(73) Assignee: OCME S.R.L., Parma (IT)

( * ) Notice: Subject to any disclaimer, the term of this patent is extended or adjusted under 35 U.S.C. 154(b) by 0 days.

(21) Appl. No.: 18/963,238

(22) Filed: Nov. 27, 2024

(65) Prior Publication Data

US 2025/0171183 A1 May 29, 2025

(30) Foreign Application Priority Data

Nov. 27, 2023 (IT) ..... 102023000025146

(51) Int. Cl.
*B65B 53/00* (2006.01)
*B65B 59/00* (2006.01)
*B65B 65/00* (2006.01)

(52) U.S. Cl.
CPC ..... *B65B 53/00* (2013.01); *B65B 59/003* (2019.05); *B65B 65/003* (2013.01)

(58) Field of Classification Search
CPC ... B65B 59/005; B65B 59/001; B65B 59/003; B65B 53/00; B65B 65/003; B65B 2210/02; B65G 2207/08; B65G 2207/30; B65G 47/841
See application file for complete search history.

(56) References Cited

U.S. PATENT DOCUMENTS 9,394,113 B2 7/2016 Werner
2010/0170201 A1* 7/2010 Aquarius ..... B65B 35/56 53/531
2012/0023866 A1* 2/2012 Rabec ..... B65B 59/003 53/235
2018/0251315 A1 9/2018 Wittmann

FOREIGN PATENT DOCUMENTS

EP 1223105 A1 7/2002

* cited by examiner

*Primary Examiner* — Thomas M Wittenschlaeger
(74) *Attorney, Agent, or Firm* — Dickinson Wright PLLC; Andrew D. Dorisio

(57) ABSTRACT

A shrink wrapper machine includes a support frame including fixed support means defining an imaginary sliding plane, a first mobile support plane placeable on the fixed support means in a first position to lie on the sliding plane to support products, a final support plane placeable on the sliding plane in a final position to support the products, adjacent to the first support plane when in the first position, moving means activatable to move the first support plane from a rest position inside a storage area to an intermediate position, on the sliding plane and placed in the first position by a first displacement occurring on the sliding plane, and moving the final support plane from a final position inside the storage area to the final position, and advancing means supported by the frame for advancing products on the first support plane and final support plane along a direction on the sliding plane.

12 Claims, 10 Drawing Sheets

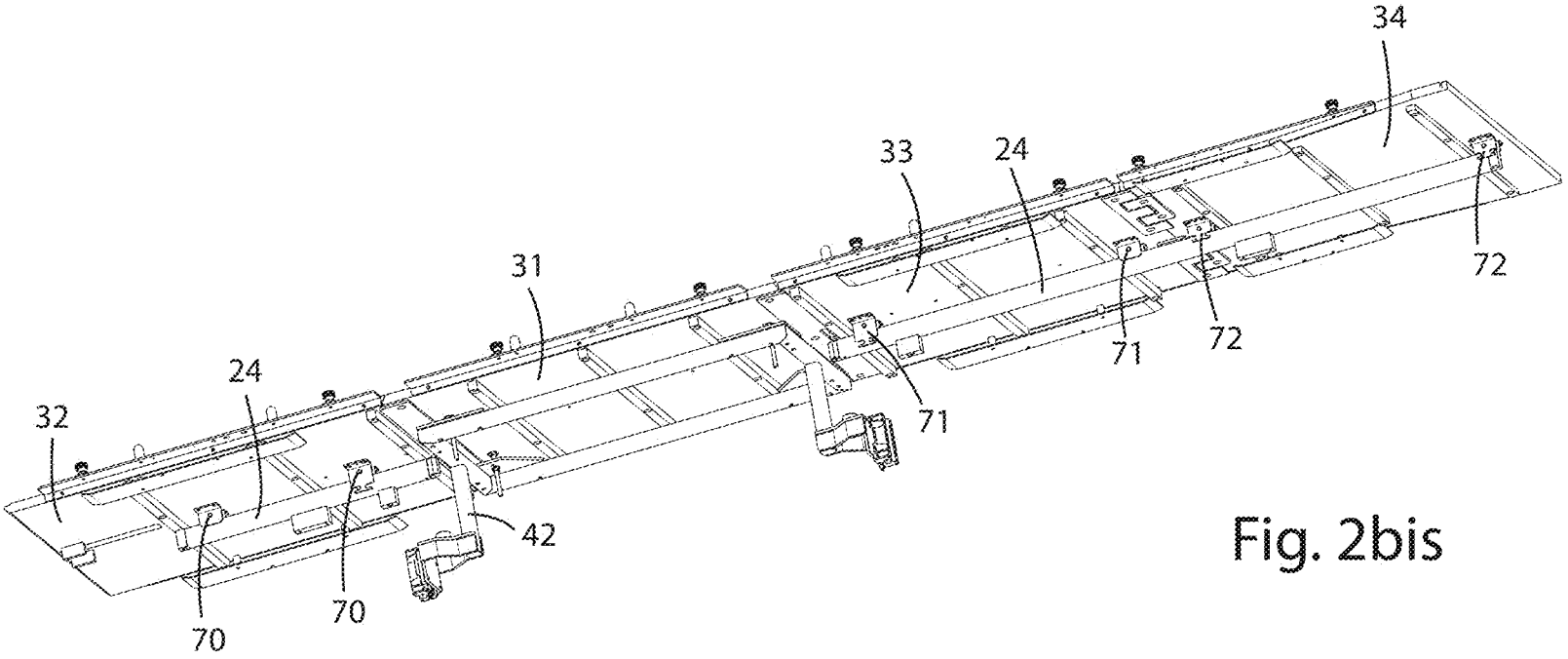
Fig. 2bis

SHRINK WRAPPER MACHINE

This application claims priority to Italian Patent Application No. 102023000025146 filed on Nov. 27, 2023, the disclosure of which is incorporated herein by reference.

TECHNICAL FIELD

The present invention relates to a shrink wrapper machine for wrapping groups of one or more products, and particularly for making wraps of products according to different formats.

BACKGROUND

In the packing field, automatic packing machines capable of autonomously making different secondary or tertiary packaging formats for products such as for example bottles, jars, tins, cans, or containers have been known for some time.

Such packaging formats can consist, for example, of cardboard boxes containing the products, or shrink film bundles in which the products are wrapped, or even packs in which the products are disposed on a cardboard tray and then wrapped with shrink film. Particularly, an automatic wrapping machine that uses shrink film to make bundles and/or packs also with cardboard trays is referred to as a shrink wrapper machine.

In the field, shrink wrapper machines are already widespread, capable of making, with a specific design change, both bundles of only shrink film and packs with cardboard trays and shrink film.

Such machines particularly have, upstream of the zone in which the products are wrapped with shrink film, a so-called "gluing zone," in which, when the machine is in a first design suitable for making packs with a cardboard tray, the products to be packed are disposed on top of a cardboard die-cut, which, while being pushed towards the next processing zone, is folded and glued to form a tray which contains the products. In the first design, the products, as they advance through the gluing zone, are supported by the die-cut itself, which in turn is supported to the sides and advanced by two prongs and two counter-prongs moved by two pairs of specific motorized chains, and centrally leans on a plurality of support plates disposed between the motorized chains. When it is necessary instead to make bundles of only shrink film, no operation is performed in the gluing zone of the machine, and the products must simply be moved towards the next processing zone, but in this case, it is not possible to employ the cardboard die-cuts to support the products during movement. For this reason, the shrink wrapper machine is set up in a second design, in which the two outermost motorized chains are placed outside the path of the products, and the support plates are replaced by larger support planes sustained by the two innermost motorized chains (which in turn are supported by respective beams) and capable of supporting the products as they advance through the gluing zone, forming a transit plane throughout the gluing zone. Currently, in order to perform the design change of the shrink wrapper machine, the support planes are manually placed on the frame of the machine in place of the support plates, but such solution has numerous drawbacks. Indeed, it is a long and tiring operation, as it requires the intervention of at least two operators handling a large number of support planes: indeed, the support planes, in order to comply with regulations regarding manual handling of loads, must have a limited weight, and consequently limited dimensions, and thus must necessarily be numerous for allowing to form a transit plane throughout the gluing zone. Furthermore, storing such support planes when not mounted on the machine requires employing a specific mobile cart, as the support planes must be transported as close as possible to the machine to perform the design change: using the cart, whose movement further increases the time required to perform the design change, also represents a non-negligible cost.

SUMMARY

The object of the present invention is to overcome the above-mentioned drawbacks, and particularly to create a shrink wrapper machine for which a quick design change, which requires limited effort from the operators involved, can be performed.

This and other results are obtained according to the present invention by making a shrink wrapper machine according to claim 1.

Further features of the shrink wrapper machine are the object of the dependent claims.

BRIEF DESCRIPTION OF THE DRAWINGS

The present invention will now be described, by way of illustration but not limitation, according to its preferred embodiments, with reference to the attached figures, wherein:

FIG. 2-*bis* is a bottom perspective view of a transit plane formed by a plurality of support planes and mounted on a shrink wrapper machine according to the invention, arranged in a design for making bundles;

With reference to FIG. 1, 1 indicates, as a whole, a shrink wrapper machine, and particularly a gluing zone thereof, arranged in the design suitable for making bundles of groups of products P wrapped only by film. The shrink wrapper machine 1 comprises a support frame 2, which in turn comprises fixed support means preferably designed as two lateral support elements 20, 21 and a central rail 24 (visible in FIGS. 2-*bis* and 3) that extend parallel to an advance direction A and define an imaginary sliding plane disposed horizontally, on which the advance direction A lies, and which defines a storage area under it, with reference to a vertical direction Z perpendicular to the sliding plane. Preferably, the lateral support elements 20, 21 consist of two support chains which, when the shrink wrapper machine 1 is arranged in the design suitable for making packs with a cardboard tray, are moved to advance the products along the advance direction A. Such support chains are sustained by respective support beams forming part of the support frame 2.

DETAILED DESCRIPTION

Figure 2:
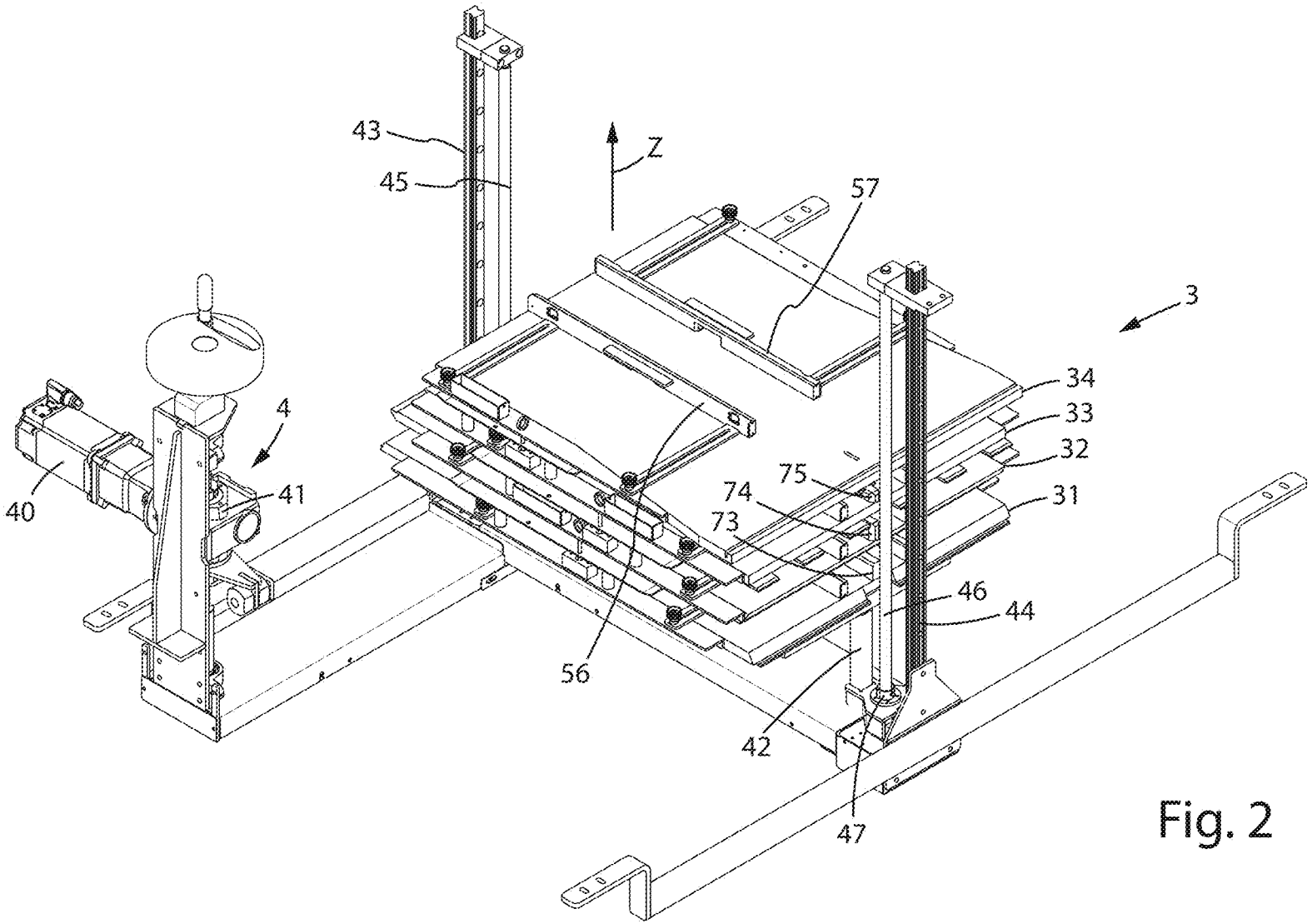
FIG. 2 is a perspective view of a format change apparatus mountable on a shrink wrapper machine according to the invention.

With reference to FIG. 2, the shrink wrapper machine 1 further comprises a format change apparatus 3 that, in turn, comprises moving means 4, a final support plane 31, a first mobile support plane 32, a second mobile support plane 33, and a third mobile support plane 34. The apparatus 3 is designed to operate a format change on the shrink wrapper machine 1, converting it from a design suitable for making packs of products P with a tray and film to a design suitable for making bundles of products P only with film.

The moving means 4 are placed in the storage area and comprise an electric motor 40, motion transmission means 41, a carrier 42 fixed to the final support plane 31 and mobile along the vertical direction Z, and guides 43, 44 extending parallel to the vertical direction Z and designed to guide the movement of the carrier 42. More particularly, the motion transmission means 41 comprise a reducer, and two movement screws 45, 46 to which two corresponding lead screws (only one of which is visible in FIG. 2 and is indicated by number 47) are coupled, being fixed to the carrier 42. The electric motor 40, through the reducer, is activatable to rotate the movement screws 45, 46 around their own vertical axes, so that to move the carrier 42 along the vertical direction Z, thereby also moving the final support plane 31 (which is fixed to the carrier 42) parallel to the vertical direction Z. In this way, the final support plane 31 is mobile between a final rest position, lowered and defined inside the storage area, and a final operative position, raised and defined lying on the sliding plane, in which it is capable of supporting the products P. Furthermore, being the carrier 42 fixed to the final support plane 31, the moving means 4 also function as a support for the final support plane 31 when it is in the final operative position.

Alternatively, or in combination, the carrier 42 can be moved along the vertical direction Z also manually, for example by manually activating a crank.

The first mobile support plane 32 is placeable on top of the final support plane 31 so that, when the final support plane 31 is in the final rest position, the first mobile support plane 32 is supported by the final support plane 31 in a first rest position defined inside the storage area, and so that the moving means 4, when activated to lift the final support plane 31 from the final rest position towards the final operative position, also lift the first mobile support plane 32 parallel to the vertical direction Z from the first rest position to a first intermediate position in which the first mobile support plane 32 lies on the sliding plane and occupies at least partially the space that is occupied by the final support plane 31 when it is in the final operative position.

More particularly, when the first mobile support plane 32 is in the first intermediate position, it can be further slidingly moved on the sliding plane along the lateral support elements 20, 21 and along the central rail 24 until reaching a first operative position, in which it is capable of supporting the products P and lies on the sliding plane adjacent to the final support plane 31 when the latter is in the final operative position: in practice, therefore, the first mobile support plane 32 can be moved from the first intermediate position to the first operative position, in which it is placed on the lateral support elements 20, 21 and on the central rail 24, by means of a first displacement that occurs exclusively on the sliding plane. The first mobile support plane 32 is indeed preferably provided with a plurality of first wheels 70 (visible in FIG. 2-*bis*) coupled to the lower face, which are designed to roll along the central rail 24 to allow the first displacement on the sliding plane.

Furthermore, the shrink wrapper machine 1 also comprises first mobile support means which are designed to be placed between the first mobile support plane 32 and the final support plane 31 when they are superimposed, so that to allow the first mobile support plane 32 to slide on top of the final support plane 31 from the first intermediate position to the first operative position. Particularly, the first mobile support means consist of a first central guide 73 (an end of which is visible in FIG. 2) placeable on top of the final support plane 31, so that to be disposed as a continuation of the central rail 24, and being shaped so that the first wheels 70 can roll along it during the first displacement before starting to roll along the central rail 24.

The second mobile support plane 33 is placeable on top of the first mobile support plane 32, so that, when the first mobile support plane 32 is in the first rest position, the second mobile support plane 33 is supported by the first mobile support plane 32 in a second rest position defined inside the storage area, and so that the moving means 4, when activated to lift the final support plane 31 from the final rest position towards the final operative position, also lift the second mobile support plane 33 parallel to the vertical direction Z from the second rest position to a second intermediate position in which the second mobile support plane 33 lies on the sliding plane and occupies at least partially the space that is occupied by the final support plane 31 when it is in the final operative position.

More particularly, similarly to what is described for the first mobile support plane 32, when the second mobile support plane 33 is in the second intermediate position, it can be further slidingly moved on the sliding plane along the lateral support elements 20, 21 and along the central rail 24 until reaching a second operative position, in which it is capable of supporting the products P and lies on the sliding plane adjacent to the final support plane 31 when the latter is in the final operative position, on the opposite side of the first mobile support plane 32 when it is in the first operative position: in practice, therefore, the second mobile support plane 33 can be moved from the second intermediate position to the second operative position, in which it is placed on the lateral support elements 20, 21 and on the central rail 24 on the opposite side of the first mobile support plane 32 when it is in the first operative position, by means of a second displacement that occurs exclusively on the sliding plane. The second mobile support plane 33 is indeed also provided with a plurality of second wheels 71 (visible in FIG. 2-*bis*) coupled to the lower face thereof, which are designed to roll along the central rail 24 to allow the second displacement on the sliding plane.

Furthermore, the shrink wrapper machine 1 also comprises second mobile support means which are designed to be placed between the second mobile support plane 33 and the first mobile support plane 32 when they are superimposed, so that to allow the second mobile support plane 33 to slide on top of the first mobile support plane 32 from the second intermediate position to the second operative position. Particularly, the second mobile support means consist of a second central guide 74 (one end of which is visible in FIG. 2), placeable on top of the first support plane 32 so that to be disposed as a continuation of the central rail 24, and being shaped so that the second wheels 71 can roll along it during the second displacement, before starting to roll along the central rail 24.

The third mobile support plane 34 is placeable on top of the second mobile support plane 33 so that, when the second mobile support plane 33 is in the second rest position, the third mobile support plane 34 is supported by the second mobile support plane 33 in a third rest position defined inside the storage area, and so that the moving means 4, when activated to lift the final support plane 31 from the final rest position towards the final operative position, also lift the third mobile support plane 34 parallel to the vertical direction Z from the third rest position to a third intermediate position, in which the third mobile support plane 34 lies on the sliding plane and at least partially occupies the space that is occupied by the final support plane 31 when it is in the operative position. The support planes 31, 32, 33, 34, when in the respective rest positions, are thus stacked on top of each other in the storage area and can be moved simultaneously by the moving means 4.

More particularly, when the third mobile support plane 34 is in the third intermediate position, it can be further slidingly moved on the sliding plane along the lateral support elements 20, 21 and along the central rail 24 until reaching a third operative position, in which it is capable of supporting the products P and lies on the sliding plane adjacent to the second mobile support plane 33 when the latter is in the second operative position, so that the first mobile support plane 32, the final support plane 31, the second mobile support plane 33, and the third mobile support plane 34 are aligned along the advance direction A when in the respective operative positions, forming a substantially continuous transit plane for the products P: in practice, therefore, the third mobile support plane 33 can be moved from the third intermediate position to the third operative position, in which it is placed on the lateral support elements 20, 21 and on the central rail 24, by means of a third displacement that occurs exclusively on the sliding plane, passing through the space region that is occupied by the second mobile support plane 33 when it is in the second operative position. The third mobile support plane 34 is indeed also provided with a plurality of third wheels 72 (visible in FIG. 2-*bis*), coupled to the lower face thereof, which are designed to roll along the central rail 24 to allow the third displacement on the sliding plane.

Furthermore, the shrink wrapper machine 1 also comprises third mobile support means which are designed to be placed between the third mobile support plane 34 and the second mobile support plane 33 when they are superimposed, so that to allow the third mobile support plane 34 to slide on top of the second mobile support plane 33 from the third intermediate position in the direction of the third operative position. In particular, the third mobile support means consist of a third central guide 75 (one end of which is visible in FIG. 2), placeable on top of the second support plane 33 so that to be disposed as a continuation of the central rail 24, and being shaped so that the third wheels 72 can roll along it during the third displacement, before starting to roll along the central rail 24.

Preferably, the support planes 31, 32, 33, 34 are made of polyethylene, so that to be rigid and durable and allow a limited-friction of the products P thereon.

Figure 1:
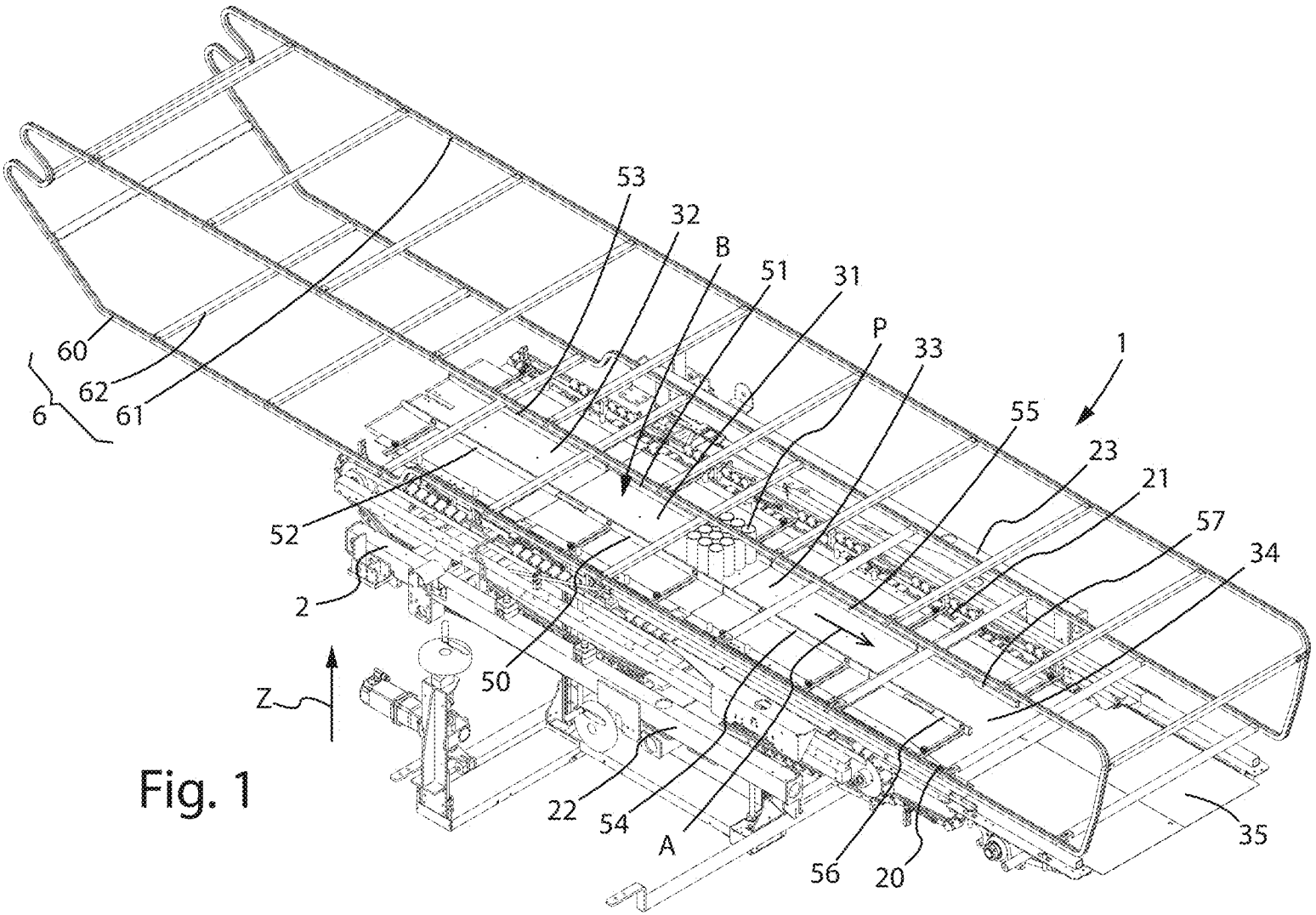
FIG. 1 is a perspective view of a gluing zone of a shrink wrapper machine according to the invention, arranged in a design for making bundles.

With reference to FIG. 1, preferably the final support plane 31 and the first mobile support plane 32 respectively comprise final guide means and first guide means designed to, when the final support plane 31 and the first mobile support plane 32 are in the respective operative positions, guide the products P along the advance direction A. Particularly, the final guide means comprise two final guides 50, 51 that extend parallel to the advance direction A and are freely movable perpendicular to the advance direction A, so that to define between them an advance track B for the products P that is adjustable in width depending on the size of the bundle to be made.

Similarly, the first guide means comprise two first guides 52, 53 adjustable in width.

Preferably, the second mobile support plane 33 and the third mobile support plane 34 also comprise second guide means and third guide means, respectively, which in turn comprise two second guides 54, 55 and two third guides 56, 57, respectively.

Furthermore, preferably, the shrink wrapper machine 1 also comprises cover means designed to cover the first mobile support plane 32 and the fixed support plane 31 when they are stacked on top of each other in the respective rest positions in the storage area. Particularly, the cover means can consist of a lid 76 (visible in FIGS. 3 to 6) placeable on top of the third mobile support plane 34, so that, when the support planes 31, 32, 33, 34 are stacked on top of each other, the lid 76 covers them all, protecting them from accidental damage, such as for example those caused by the falling of the products P in the event of a malfunction of the shrink wrapper machine 1 when it is in the design for making packs with a cardboard tray, and therefore when the support planes 31, 32, 33, 34 are stacked on top of each other in the storage area.

The shrink wrapper machine 1 has been described in the preferred embodiment, wherein it comprises three mobile support planes 32, 33, 34, as it has been observed to represent an optimal compromise for obtaining a quick format change while limiting the footprint and overall costs. However, particularly in the case where the shrink wrapper machine 1 has dimensions different from those commonly characterizing the equipment of the field, or when it is placed in environments requiring different project solutions, the shrink wrapper machine can comprise one or more further mobile support planes. Such further mobile support planes, if present, are stackable on top of the third mobile support plane 34 in the storage area and can be slidingly moved on the sliding plane along the lateral support elements 20, 21 and along the central rail 24 until reaching the respective operative positions.

On the other hand, if the available space so allows, the shrink wrapper machine 1 can also comprise fewer mobile support planes than those described: particularly, the shrink wrapper machine 1 can also comprise only the final support plane 31 and the first mobile support plane 32, or only the final support plane 31, the first mobile support plane 32, and the second mobile support plane 33.

In any case, the shrink wrapper machine 1 can also comprise a transition plane 35 placeable downstream of the last mobile support plane (in the case depicted, downstream of the third mobile support plane 34) and adjacent to it to complete the transit plane: particularly, the transition plane 35 can be snap-in fixed to the third mobile support plane 34, and allows the products P to advance towards the next processing zone. Such transition plane 35 can also coincide with the lid 76, which can be disposed downstream of the third mobile support plane 34 once it has been removed from the top of the third mobile support plane 34.

Figure 15:
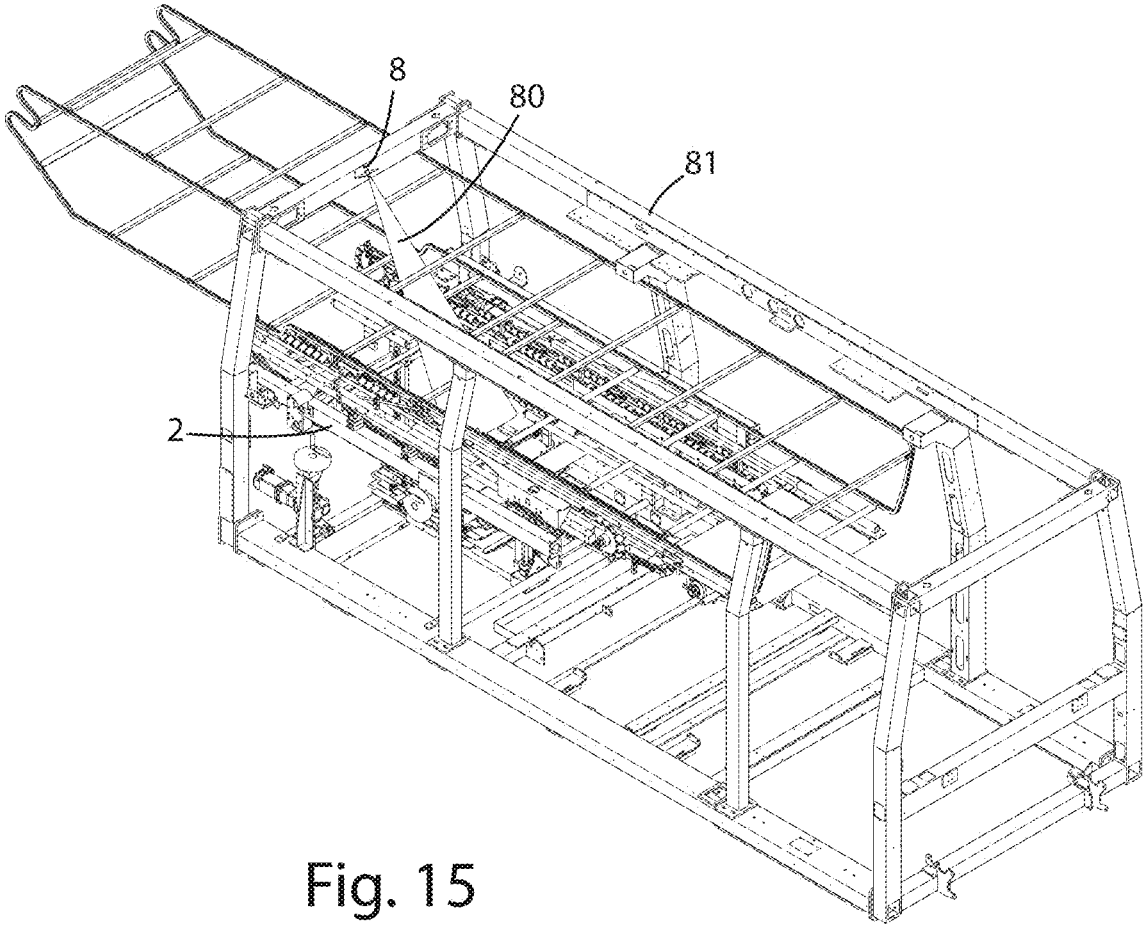
FIG. 15 is a perspective view of a gluing zone of a shrink wrapper machine according to the invention, provided with a support structure and a safety apparatus.

The shrink wrapper machine 1 further comprises a safety apparatus designed to detect if the space region that is occupied by the final support plane 31 when it is in the final operative position is occupied, for example, by the final support plane 31 itself, by the mobile support planes 32, 33, 34, or by other objects against which the support planes 31, 32, 33, 34 could collide during the lifting thereof from the storage area towards the sliding plane: such objects can particularly consist of the support plates mounted on the shrink wrapper machine 1 in the design for making packs with a cardboard tray, in the event they have not been properly removed to allow the activation of the format change apparatus 3. The safety apparatus is further designed to prevent an activation of the moving means 4 if the aforementioned space region is occupied, so that to prevent a collision of the support planes 31, 32, 33, 34 with other objects present in such space region. Particularly, with reference to FIG. 15, the safety apparatus can comprise a photocell 8 having a detection region 80 that at least partially includes the aforementioned space region and is operatively to the moving means 4. Preferably, the photocell 8 is supported by a support structure 81 integral with the frame 2.

The shrink wrapper machine 1 finally comprises advancing means 6 supported by the frame 2 and designed to advance the products P along the advance direction A on top of the support planes 31, 32, 33, 34 when in the respective operative positions. Particularly, the advancing means 6 comprise a first advance chain 60 and a second advance chain 61, carried by a first advance beam 22 and a second advance beam 23, respectively, forming part of the frame and disposed outside the lateral support elements 20, 21: the advance chains 60, 61 are tensioned by a plurality of pulleys (not depicted in the figures) supported by the frame, and form two closed loops disposed on the sides of the support planes 31, 32, 33, 34. The advance chains 60, 61 carry between them a plurality of advance bars 62 disposed perpendicular to the advance direction A. In this way, by circulating the advance chains 60, 61 on the pulleys, the advance bars 62 are moved parallel to the advance direction A, contacting the products P and advancing them.

More particularly, the advance beams 22, 23 can be separated perpendicular to the advance direction A, and the advance bars 62 can be decoupled from the advance chains 60, 61: in this way, a possible operator can be allowed to approach the format change apparatus 3 and move the mobile support planes 32, 33, 34 along the lateral support elements 20, 21 and along the central rail 24 to move them from the respective intermediate positions towards the respective operative positions. In use, when the shrink wrapper machine 1 is in the design suitable for making packs of products P with a tray and film, it has a plurality of support plates resting on the central rail 24, and the support planes 31, 32, 33, 34 are stacked on top of each other in the storage area in the respective rest positions, under the sliding plane, the corresponding central guides 73, 74, 75 are placed between them, and the lid 76 is placed on top of the third mobile support plane 34.

Figure 3:
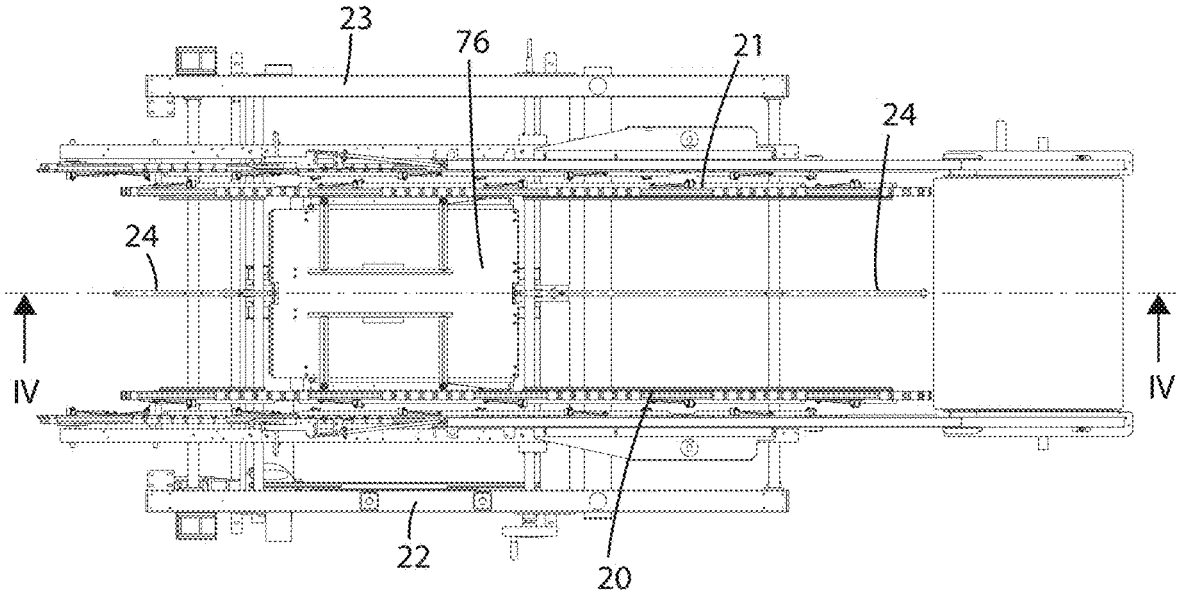
FIG. 3 is a top view of a gluing zone of a shrink wrapper machine according to the invention with parts removed for clarity, where support planes are in the respective rest positions.
Figure 4:
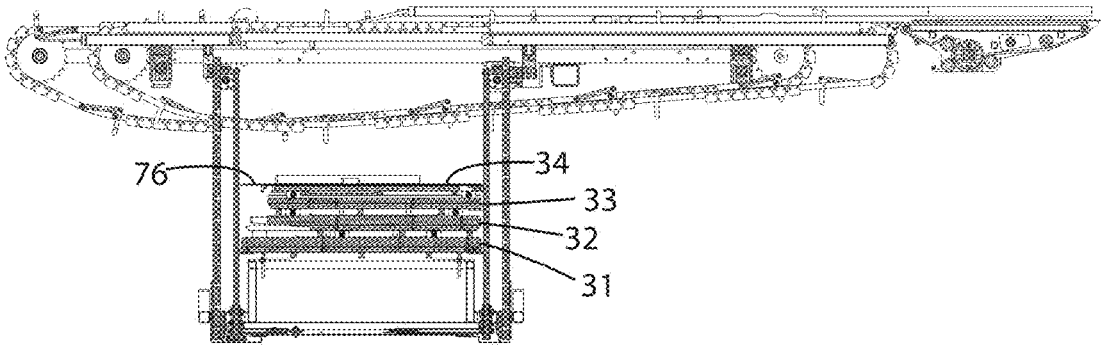
FIG. 4 is a sectional view along plane IV-IV of FIG. 3.

With reference to FIGS. 3 and 4, in order to operate a format change, first, the support plates are removed, the advance bars 62 are removed, and the advance beams 22, 23 are separated.

Figure 5:
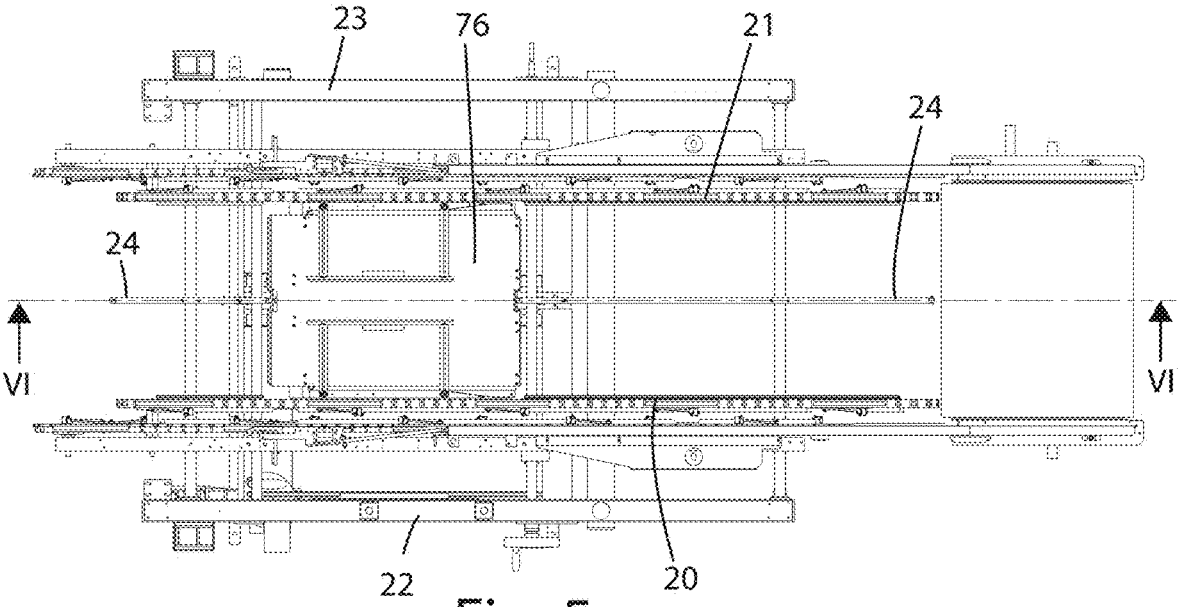
FIG. 5 is a top view of a gluing zone of a shrink wrapper machine according to the invention with parts removed for clarity, where the third mobile support plane is in a third intermediate position.
Figure 6:
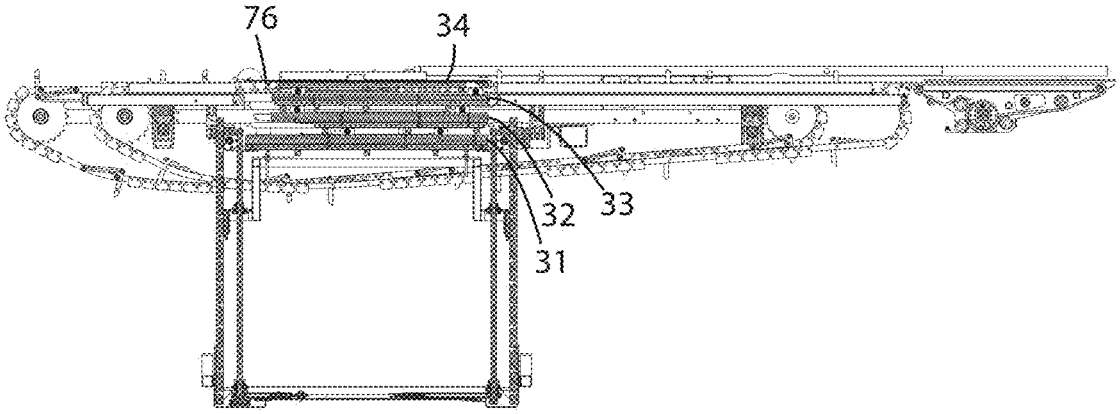
FIG. 6 is a sectional view along plane VI-VI of FIG. 5.

Next, with reference to FIGS. 5 and 6, if the safety apparatus does not detect the occupation of the space region occupied by the final support plane 31 when it is in the final operative position, the moving means 4 are activated, and the support planes 31, 32, 33, 34 are lifted along the vertical direction Z until the third mobile support plane 34 lies on the sliding plane in the third intermediate position, thus occupying the space region that is occupied by the final support plane 31 when it is in the final operative position.

Figure 7:
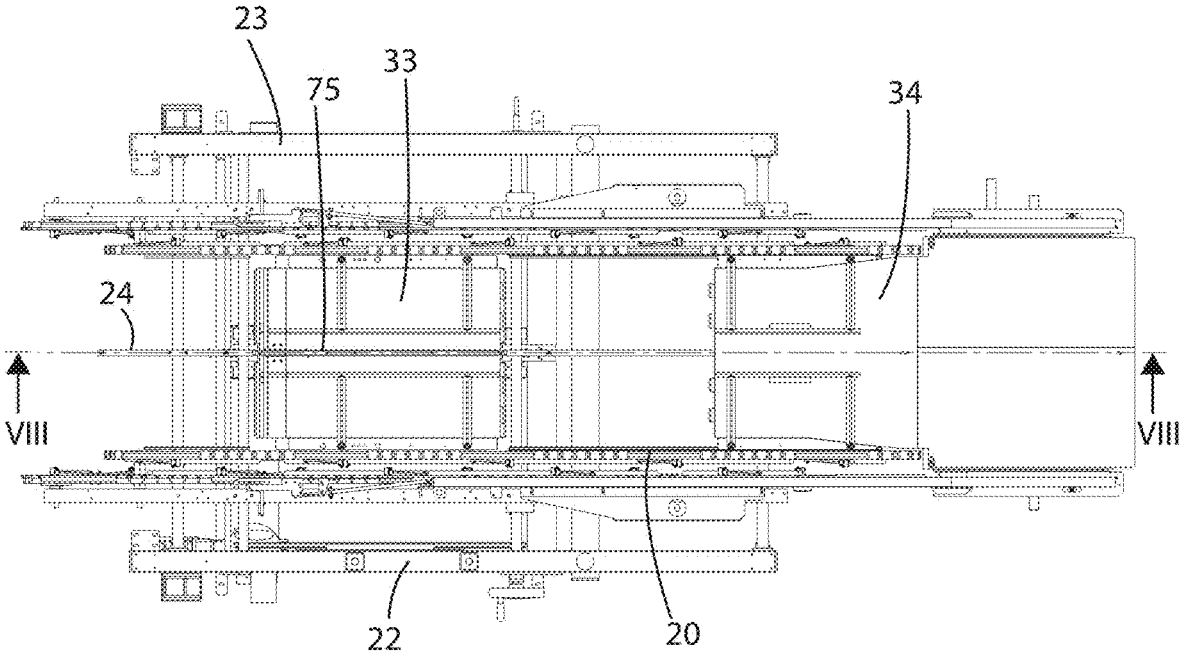
FIG. 7 is a top view of a gluing zone of a shrink wrapper machine according to the invention with parts removed for clarity, where the third mobile support plane is in a third operative position.
Figure 8:
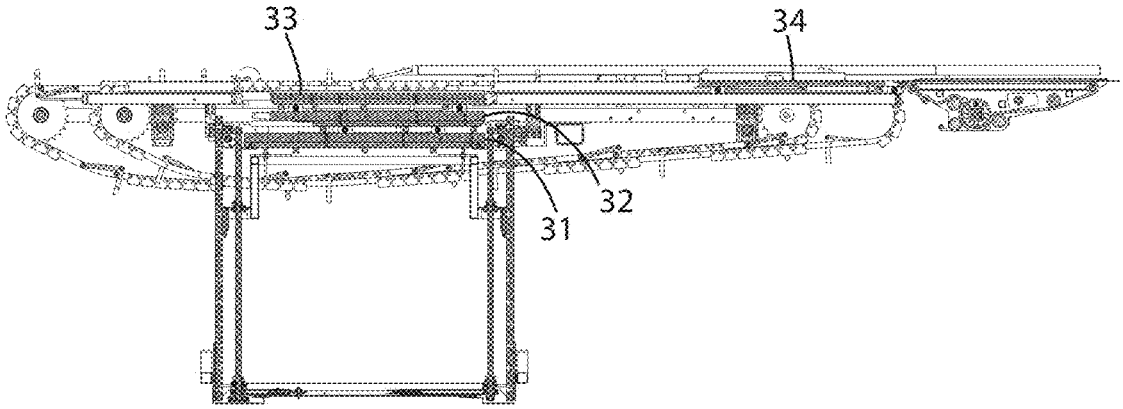
FIG. 8 is a sectional view along plane VIII-VIII of FIG. 7.

Next, with reference to FIGS. 7 and 8, the lid 76 can be removed, and the third mobile support plane 34 is manually slid on the sliding plane, first on the third central guide 75 and then along the lateral support elements 20, 21 and the central rail 24, until reaching the third operative position (making the third displacement described above). The lid 76 can then be placed as the transition plane 35, if designed for such function.

Figure 9:
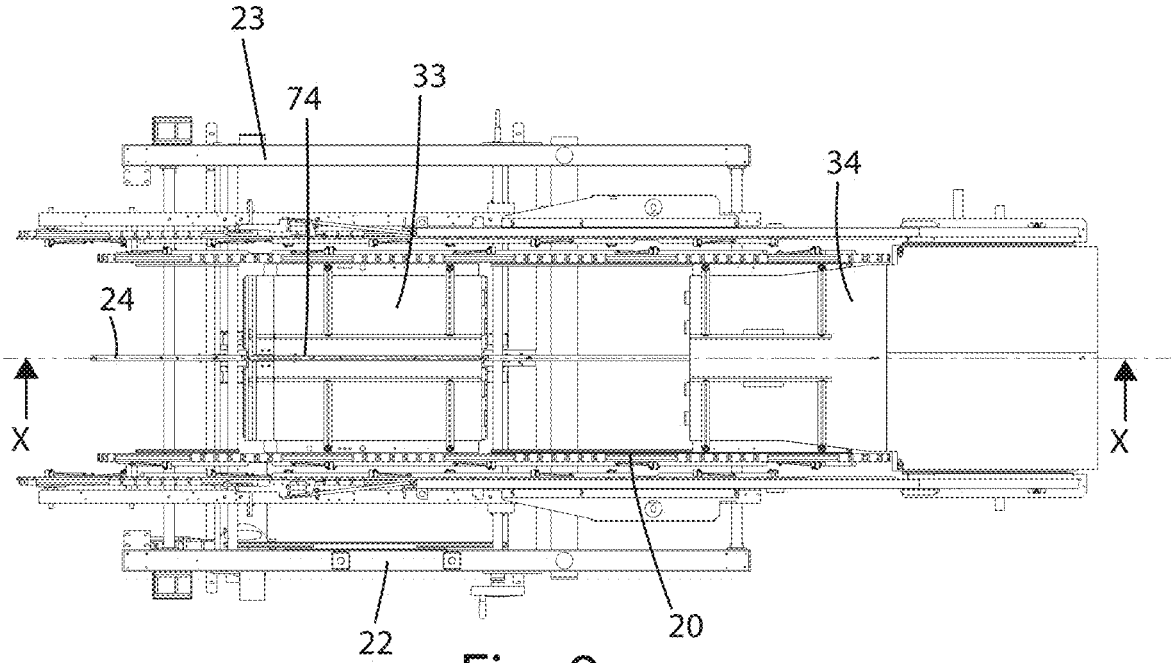
FIG. 9 is a top view of a gluing zone of a shrink wrapper machine according to the invention with parts removed for clarity, where the third mobile support plane is in the third operative position and the second mobile support plane is in a second intermediate position.
Figure 10:
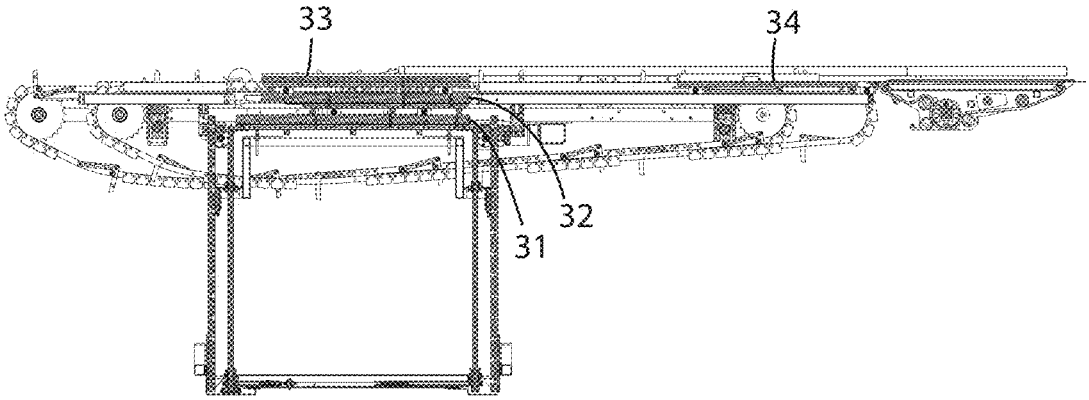
FIG. 10 is a sectional view along plane X-X of FIG. 9.

Next, with reference to FIGS. 9 and 10, the moving means 4 are activated, and the final support plane 31, the first mobile support plane 32, and the second support plane 33 (which are still stacked on top of each other in the storage area) are lifted until the second mobile support plane 33 lies on the sliding plane in the second intermediate position, thus occupying the space region that is occupied by the final support plane 31 when it is in the final operative position, and that was occupied by the third mobile support plane 34 when it was in the third intermediate position.

Figure 11:
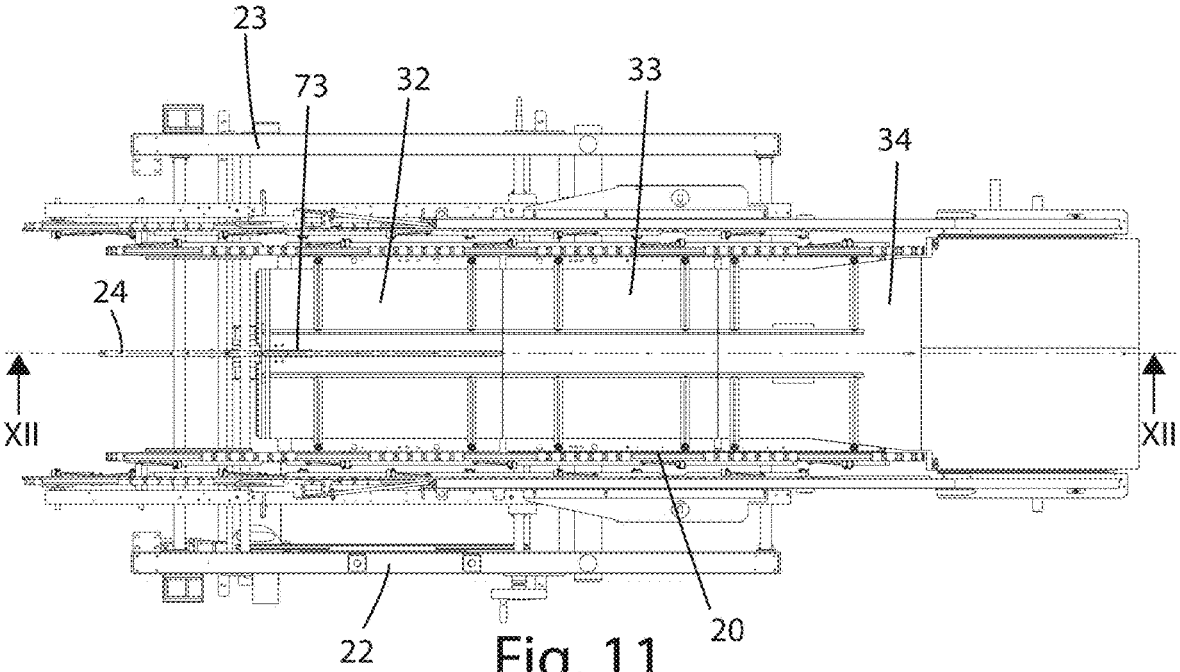
FIG. 11 is a top view of a gluing zone of a shrink wrapper machine according to the invention with parts removed for clarity, where the third mobile support plane is in the third operative position, the second mobile support plane is in a second operative position, and the first mobile support plane is in a first intermediate position.
Figure 12:
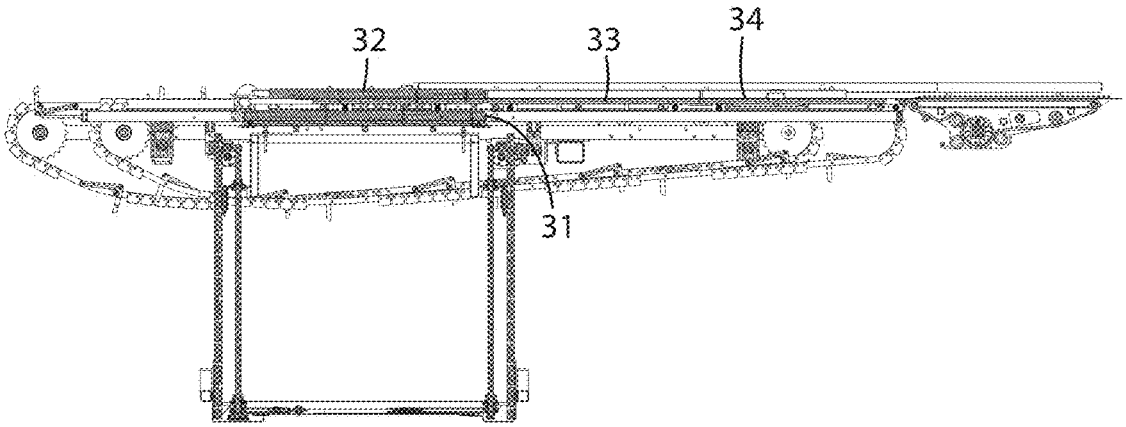
FIG. 12 is a sectional view along plane XII-XII of FIG. 11.

Next, with reference to FIGS. 11 and 12, the second mobile support plane 33 is manually slid on the sliding plane, first on the second central guide 74 and then along the lateral support elements 20, 21 and the central rail 24, until reaching the second operative position, in which it is adjacent to the third mobile support plane 34 (second displacement). The moving means 4 are then activated, and the final support plane 31 and the first mobile support plane 32 are lifted until the first mobile support plane 32 lies on the sliding plane in the first intermediate position.

Figure 13:
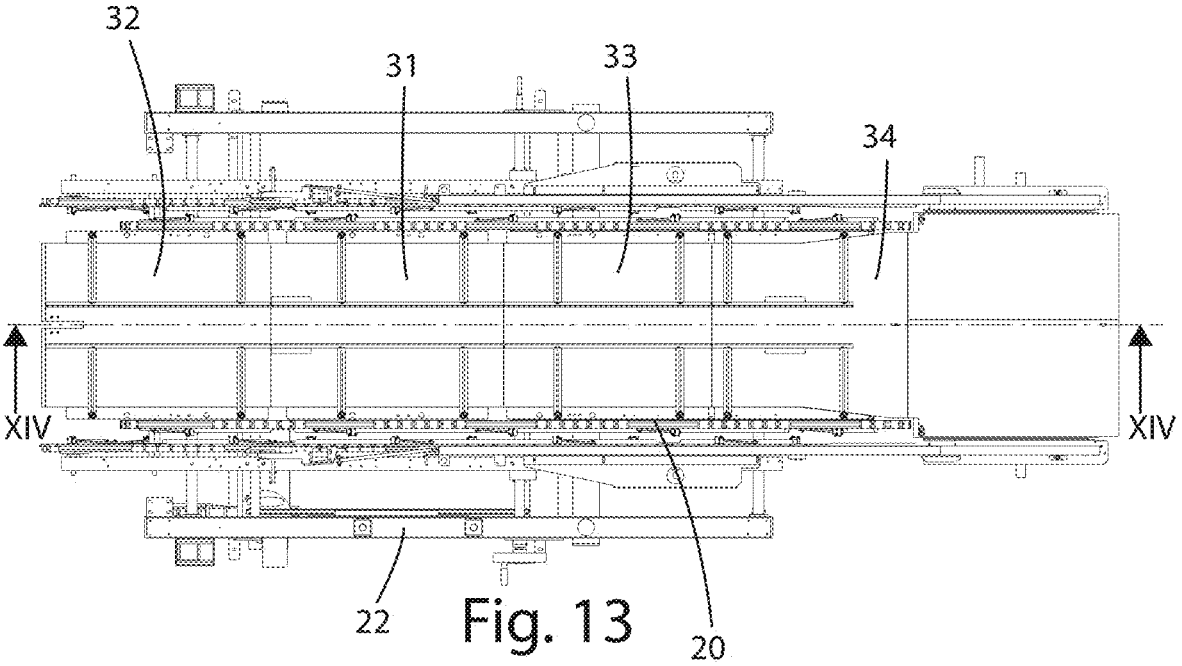
FIG. 13 is a top view of a gluing zone of a shrink wrapper machine according to the invention with parts removed for clarity, where the third mobile support plane is in the third operative position, the second mobile support plane is in the second operative position, the first mobile support plane is in a first operative position, and the final support plane is in a final operative position.
Figure 14:
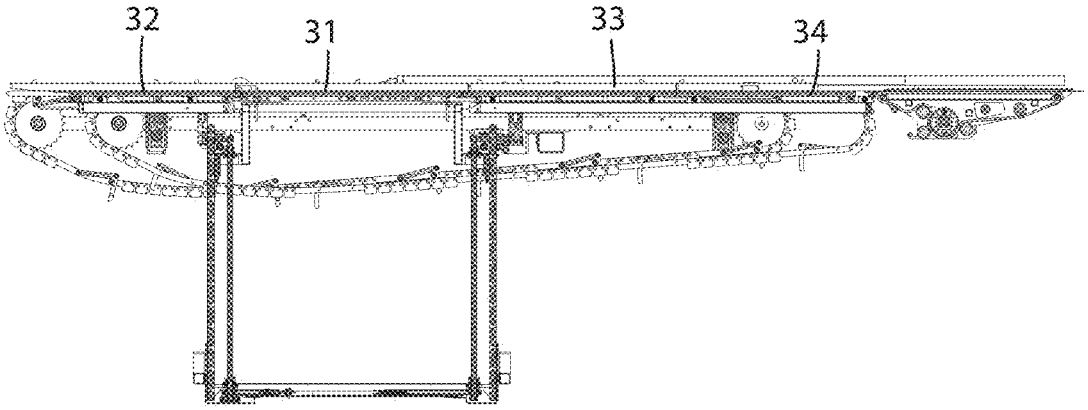
FIG. 14 is a sectional view along plane XIV-XIV of FIG. 13.

Next, with reference to FIGS. 13 and 14, the first mobile support plane 32 is manually slid on the sliding plane, first on the first central guide 73 and then along the lateral support elements 20, 21 and the central rail 24, in the opposite direction to the second displacement and third displacement, until reaching the first operative position (first displacement). The moving means 4 are then activated, and the final support plane 31 is lifted until it lies on the sliding plane in the final operative position.

As the support planes 31, 32, 33, 34 are placed in the respective operative positions, the corresponding central guides 73, 74, 75 are also removed. The advance beams 22, 23 are then brought closer together, and the advance bars 62 are mounted.

In this way, a continuous transit plane is made for the products P through the gluing zone: the shrink wrapper machine 1 is thus in the design suitable for making bundles of products P only with film. In order to return the shrink wrapper machine 1 to the design suitable for making packs with a tray, it is sufficient to perform the above-described operations in reverse order.

Particularly, the design change is particularly quick and does not require intense effort from the operators involved: indeed, they only need to slide the mobile support planes 32, 33, 34 along the lateral support elements 20, 21 and along the central rail 24, without any lifting operation.

The present invention has been described, by way of illustration but not limitation, according to preferred embodiments thereof, but it should be understood that variations and/or modifications can be made by a skilled person, without departing from the scope of protection thereof as defined in the attached claims.

The invention claimed is:

1. A shrink wrapper machine designed to wrap groups of one or more products, comprising a support frame, which in turn comprises fixed support means that define an imaginary sliding plane, at least a first mobile support plane which is placeable on said fixed support means in a first operative position so that to lie on said sliding plane in order to support said products, a final support plane which is placeable on said sliding plane in a final operative position in order to support said products and in which it is adjacent to said first mobile support plane when it is in said first operative position, and advancing means supported by said frame and designed to advance said products on said first mobile support plane and final support plane along an advance direction lying on said sliding plane, further comprising moving means activatable to move said first mobile support plane from a first rest position inside a storage area to a first intermediate position, in which it lies on said sliding plane and from which it can be placed in said first operative position by means of a first displacement that occurs on said sliding plane, and to move said final support plane from a final rest position inside said storage area to said final operative position, supporting it in said final operative position.

2. The shrink wrapper machine according to claim 1, wherein said storage area is under said sliding plane with reference to a vertical direction substantially perpendicular to said sliding plane, said moving means being designed to move said first mobile support plane and final support plane substantially parallel to said vertical direction (Z).

3. The shrink wrapper machine according to claim 2, wherein, when said first mobile support plane and final support plane are respectively in said first rest position and final rest position, said first mobile support plane is sustained by said final support plane.

4. The shrink wrapper machine according to claim 3, further comprising first mobile support means designed to be placed between said first mobile support plane and said final support plane when they are respectively in said first rest position and final rest position, and to allow said first displacement of said first mobile support plane on top of said final support plane.

5. The shrink wrapper machine according to claim 3, wherein said moving means comprise an electric motor and a carrier fixed to said final support plane, said electric motor configured to move said carrier substantially parallel to said vertical direction.

6. The shrink wrapper machine according to claim 3, further comprising at least a second mobile support plane or at least a second mobile support plane and a third mobile support plane that are placeable on said fixed support means respectively in a second operative position and a third operative position so that to lie on said sliding plane in order to support said products and in which, when said first mobile support plane and final support plane are respectively in said first operative position and final operative position, said first mobile support plane, final support plane, second mobile support plane and third mobile support plane are adjacent to each other and aligned parallel to said advance direction, said moving means being designed to move said second mobile support plane between a second rest position, defined in said storage area, and a second intermediate position, in which it lies on said sliding plane and from which it can be placed in said second operative position by means of a second displacement that occurs on said sliding plane, said moving means being further designed to move said third mobile support plane between a third rest position, defined in said storage area, and a third intermediate position, in which it lies on said sliding plane and from which it can be placed in said third operative position by means of a third displacement that occurs on said sliding plane.

7. The shrink wrapper machine according to claim 6, wherein, when said third mobile support plane, second mobile support plane and first mobile support plane are respectively in said third rest position, second rest position and first rest position, said third mobile support plane is sustained by said second mobile support plane, which is sustained by said first mobile support plane.

8. The shrink wrapper machine according to claim 1, further comprising cover means designed to cover said first mobile support plane and final support plane when they are respectively in said first rest position and final rest position.

9. The shrink wrapper machine according to claim 1, wherein said final support plane and first mobile support plane comprise respectively final guide means and first guide means designed to guide said products parallel to said advance direction when said final support plane and first mobile support plane are respectively in said final operative position and first operative position.

10. The shrink wrapper machine according to claim 9, wherein said final guide means and said first guide means comprise respectively two final guides and two first guides adjustable perpendicularly to said advance direction so that to define between them an advance track for said products.

11. The shrink wrapper machine according to claim 1, further comprising a safety apparatus designed to detect if a space region that is occupied by said final support plane when it is in said final operative position is occupied, and to prevent an activation of said moving means if said space region is occupied.

12. The shrink wrapper machine according to claim 1, wherein said fixed support means comprise two lateral support elements and a central rail extending substantially parallel to said advance direction.

* * * * *